US005730318A

United States Patent [19]

Schramm

[11] Patent Number: 5,730,318

[45] Date of Patent: Mar. 24, 1998

[54] METHOD OF AN APPARATUS FOR EVACUATING ARRAYED TUBULAR OBJECTS FROM CONTAINERS

[75] Inventor: Christian Schramm, Evry, France

[73] Assignee: Chilinov s.a.r.l., Chilly-Mazarin, France

[21] Appl. No.: 528,239

[22] Filed: Sep. 14, 1995

[30] Foreign Application Priority Data

Sep. 22, 1994 [DE] Germany ..... 44 33 850.3

[51] Int. Cl.[6] ..... G65G 59/00

[52] U.S. Cl. ..... 221/197; 221/200; 221/205; 221/266; 221/287; 221/312 B; 414/421; 414/414

[58] Field of Search ..... 414/419, 421, 414/414; 221/186, 197, 200, 205, 266, 287, 312 B

[56] References Cited

U.S. PATENT DOCUMENTS

| | | | |
|---|---|---|---|
| 636,413 | 11/1899 | Miller | 221/197 |
| 727,207 | 5/1903 | Rust | 221/266 |
| 1,682,215 | 8/1928 | Colby | 221/197 |
| 2,977,023 | 3/1961 | Meyer | 221/205 |
| 3,960,299 | 6/1976 | Hollinger | 221/266 |
| 4,324,523 | 4/1982 | Zablocky | 221/197 |
| 5,351,856 | 10/1994 | Laidlaw | 221/266 |

FOREIGN PATENT DOCUMENTS

| | | | |
|---|---|---|---|
| 0250195 | 10/1989 | Japan | 221/197 |

*Primary Examiner*—H. Grant Skaggs
*Attorney, Agent, or Firm*—Darby & Darby

[57] ABSTRACT

A container which is filled with an array of parallel hollow cylinders of cigarette paper is opened at the top and is overlapped by a retractible temporary cover prior to being partially inverted onto a downwardly sloping top wall of a magazine. The cover is thereupon retracted and the top wall is pivoted to permit entry of cylinders from the interior of the container into a chamber of te magazine. Such cylinders are thereupon caused or permitted to enter the flutes of an indexible drum-shaped conveyor which transports the cylinders seriatim to a station where successive cylinders receive rod-like fillers of particulate material, such as comminuted smokable material.

32 Claims, 5 Drawing Sheets

METHOD OF AN APPARATUS FOR EVACUATING ARRAYED TUBULAR OBJECTS FROM CONTAINERS

BACKGROUND OF THE INVENTION

The invention relates to improvements in methods of and apparatus for manipulating tubular objects, and more particularly to improvements in methods of and in apparatus for manipulating tubular objects (such as cylindrical portions of wrapping material for accumulations (particularly rod-like fillers) of particulate smokable material) preparatory to introduction of fillers. Still more particularly, the invention relates to improvements in methods of and in apparatus for introducing tubular objects into a magazine and for transferring the thus introduced objects to positions for reception of rod-like fillers or the like.

The method and the apparatus of the present invention are particularly suitable for manipulation of tubular objects (such as cylindrical bodies made of cigarette paper or the like) which are supplied in containers, e.g., in plastic, cardboard or other boxes for arrays of parallel tubular objects. The containers may but need not be filled with tubular objects even though it is presently preferred to supply tubular objects in filled containers.

OBJECTS OF THE INVENTION

An object of the invention is to provide a method which renders it possible to treat sensitive tubular objects gently, e.g., without deformation of their walls even if such walls are made of cigarette paper or similar readily deformable materials.

Another object of the invention is to provide a method which renders it possible to manipulate the tubular objects in a highly predictable fashion, particularly without causing or permitting the tubular objects from changing their orientation relative to each other.

A further object of the invention is to provide a method which renders it possible to manipulate successive tubular objects at short intervals, i.e., at a frequency which is necessary to fill successive objects with rod-like accumulations of particulate smokable material or the like.

An additional object of the invention is to provide a method which can be used for the manipulation of large numbers of tubular objects in a relatively small area.

Still another object of the invention is to provide a novel and improved apparatus for the practice of the above outlined method.

A further object of the invention is to provide the apparatus with novel and improved means for manipulating containers for arrays of tubular objects prior to transfer of their contents into a magazine.

Another object of the invention is to provide the apparatus with novel and improved means foe evacuating the contents of the magazine.

An additional object of the invention is to provide an apparatus which can treat tubular objects gently and which can manipulate short or long series of successive objects in a highly predictable manner.

SUMMARY OF THE INVENTION

One feature of the instant invention resides in the provision of a method of evacuating tubular objects through the open top of an at least partially filled container into a magazine and thereupon from the magazine. The improved method comprises the steps of placing a temporary cover (e.g., in the form of a reciprocable panel) onto the open top of the container, partially inverting the container jointly with the temporary cover to thus position the temporary cover beneath the partially inverted container above a mobile top wall of the magazine in an inclined plane making an angle of less than 90° (for example, at least close to 45°) with a horizontal plane and to thus convert the temporary cover into a temporary bottom of the partially inverted container, at least partially removing the converted temporary cover from the open top of the partially inverted container, and moving the top wall of the magazine substantially downwardly to at least one lowered position in which the thus lowered top wall bounds an object-receiving chamber of the magazine.

The tubular objects can comprise or constitute substantially cylindrical portions of wrapping material (such as cigarette paper) for accumulations of particulate smokable material (such as shredded and/or otherwise cut tobacco leaf laminae and/or comminuted tobacco ribs and/or comminuted sheets or foils of reconstituted tobacco and/or substitute tobacco).

The container can resemble or constitute a box made of plastic, cardboard or other suitable material and having a lid (e.g., a lid with one or more flaps) movable to and from a position in which the top of the container is open. The container can be of the type having an at least substantially flat bottom, and the step of placing the temporary cover onto the open top of the container can include moving the temporary cover in at least substantial parallelism with the bottom of the container. The step of at least partially removing the converted temporary cover (i.e., the temporary bottom) can include moving the converted temporary cover in at least substantial parallelism with the at least substantially flat bottom of the container.

The step of at least partially inverting the container can include pivoting the container and a receptacle therefor through an angular distance of between about 120° and 150°, e.g., at least close to 135°. It is presently preferred to select the step of partially inverting the container in such a way that the container and its receptacle are pivoted (through the angular distance of between about 120° and 150°) from at least substantially horizontal positions.

The step of at least partially removing the converted temporary cover can take place, at least in part, simultaneously with the step of moving the top wall of the magazine substantially downwardly. Such step of moving the top wall substantially downwardly can be carried out by one or more displacing elements of the converted temporary cover. A presently preferred converted temporary cover has a first end portion at a first level and a second end portion at a lower second level, and the displacing element or elements are preferably disposed at the second end portion of the converted temporary cover.

The method preferably further comprises the step of evacuating tubular objects from the chamber of the magazine by an intermittently driven conveyor, preferably by an intermittently rotated fluted drum, subsequent to movement of the top wall of the magazine to the at least one lowered position. The intermittently driven conveyor can transport tubular objects from the chamber of the magazine to a filling station where the objects can receive suitable fillers, e.g., rods of properly condensed or compacted particulate smokable material. Such method can further comprise the step of agitating the top wall of the magazine (e.g., with one or more electromagnetic vibrators) during transport of objects to the filling station. In addition to or in lieu of agitation of the top wall of the magazine during intermittent transport of objects to the filling station, the top wall of the magazine can be agitated during movement of such top wall to the at least one lowered position.

Another feature of the invention resides in the provision of an apparatus for evacuating tubular objects through the open top of an at least partially filled container first into and thereupon from a magazine. The apparatus comprises a removable temporary cover for the open top of the container, means for partially inverting the container jointly with the temporary cover to thus position the temporary cover beneath the partially inverted container and above a mobile top wall of the magazine in an inclined plane making an angle of less than 90° with a horizontal plane and to thus convert the temporary cover into a removable temporary bottom for the partially inverted container, and means for moving the top wall of the magazine substantially downwardly to at least one lowered position in which the objects can enter the magazine. The aforementioned angle is or can be at least close to 45°, and the tubular objects can comprise or constitute substantially cylindrical portions of wrapping material (e.g., cigarette paper) for substantially rod-shaped accumulations of particulate smokable material.

As already mentioned hereinabove, the container can constitute or resemble a box (e.g., a parallelepiped box) having a lid which is movable (e.g., pivotable) to and from a position in which it overlies the top of the container, i.e., from and to a position in which the top of the container is open.

The means for partially inverting the container preferably comprises a receptacle for containers with open tops. Such receptacle preferably comprises guide means (e.g., one or more rails) for the temporary cover; the temporary cover is movable relative to the container in the receptacle to and from a position in which the temporary cover at least substantially overlies the open top of the container in the receptacle. The containers can be of the type having substantially flat bottoms, and the guide means can be positioned on or relative to the receptacle in such a way that it can maintain the temporary cover in substantial parallelism with the substantially flat bottom of the container in the receptacle. The converted temporary cover is or can be movable relative to the guide means in the partially inverted position of the container in the receptacle from a position of overlap with the open top of the partially inverted container.

The means (including the aforementioned receptacle) for partially inverting the container can include means for pivoting the container back and forth through angular distances of between about 120° and 150°, e.g., at least close to 135°.

As already mentioned above, the converted temporary cover is movable relative to the open top of the partially inverted container, and the means for moving the top wall can share the movements of the converted temporary cover. A presently preferred temporary cover includes a first end portion at a first level and a second end portion at a lower second level (in the partially inverted position of the container), and the means for moving the top wall is preferably disposed at the second end portion of the converted temporary cover. Such means for moving the top wall of the magazine can include one or more projections on the temporary cover.

The apparatus can further comprise means for transporting discrete objects from the magazine to a filling station where the objects receive substantially rod-shaped accumulations of particulate smokable material. Such transporting means can comprise a rotary fluted conveyor (e.g., a cylindrical drum) and means for rotating the conveyor in stepwise fashion; the conveyor is or can be located at least in part beneath the magazine. The apparatus embodying the fluted conveyor can further comprise means (e.g., one or more electromagnetic vibrators) for agitating the top wall of the magazine, at least during intermittent rotation of the conveyor. The just mentioned agitating means and/or additional agitating means can serve to agitate the top wall of the magazine at least during movement of the top wall to the at least one lowered position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

Figure 6:
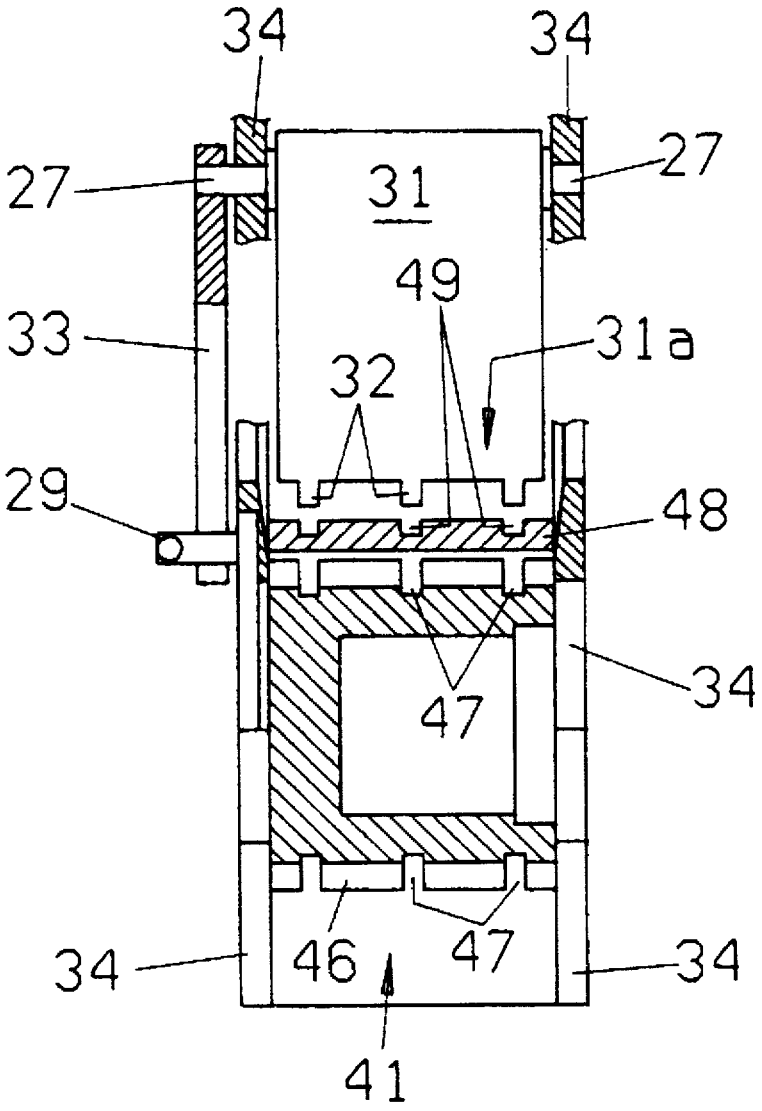

FIG. **5*a*** is a vertical sectional view of a receptacle forming part of the means for partially inverting at least partially filled containers, the temporary cover being shown in the position in which it overlies the open top of a filled container, the container and the receptacle being shown in positions they assume prior to partial inversion;

FIG. **5*b*** is a vertical sectional view of the magazine and of the means for tranporting tubular objects from the magazine to a filling station;

FIG. 6 is a vertical sectional view, partly as seen in the direction of arrows from the line A—A and partly as seen in the direction of arrows from the line B—B in FIG. **5*b*;**

Figure 8:
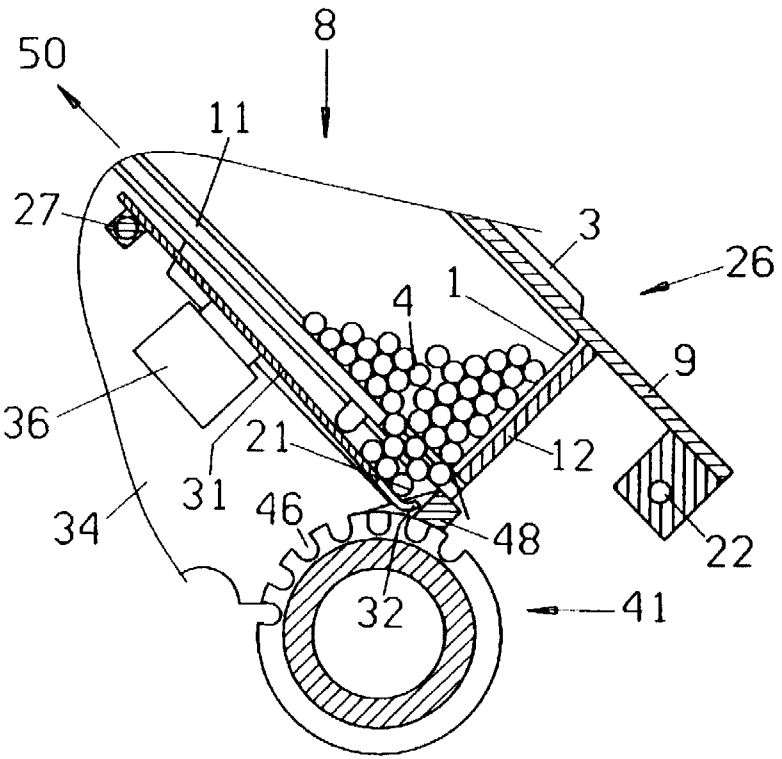
Figure 7:
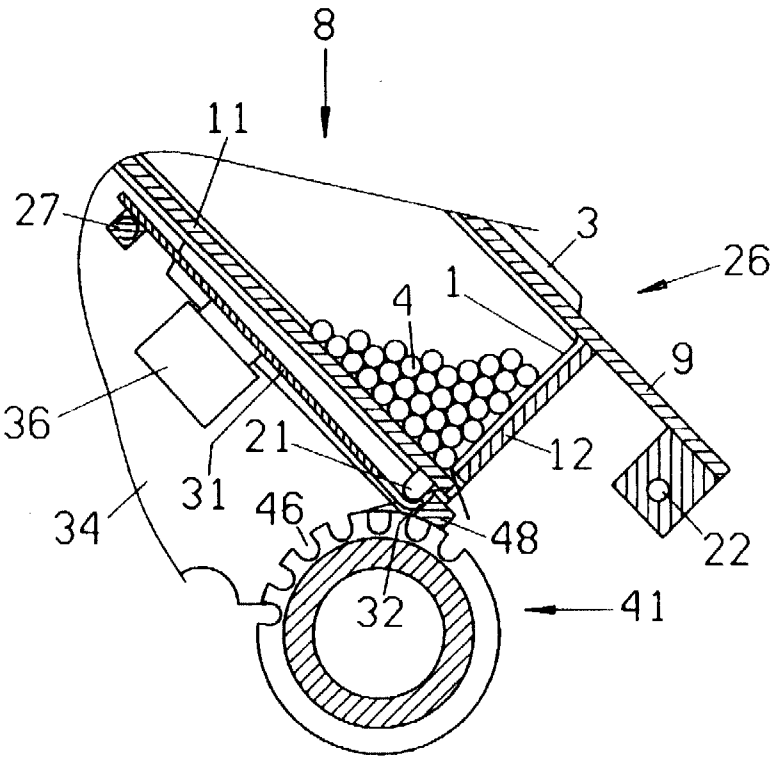
Figure 10:
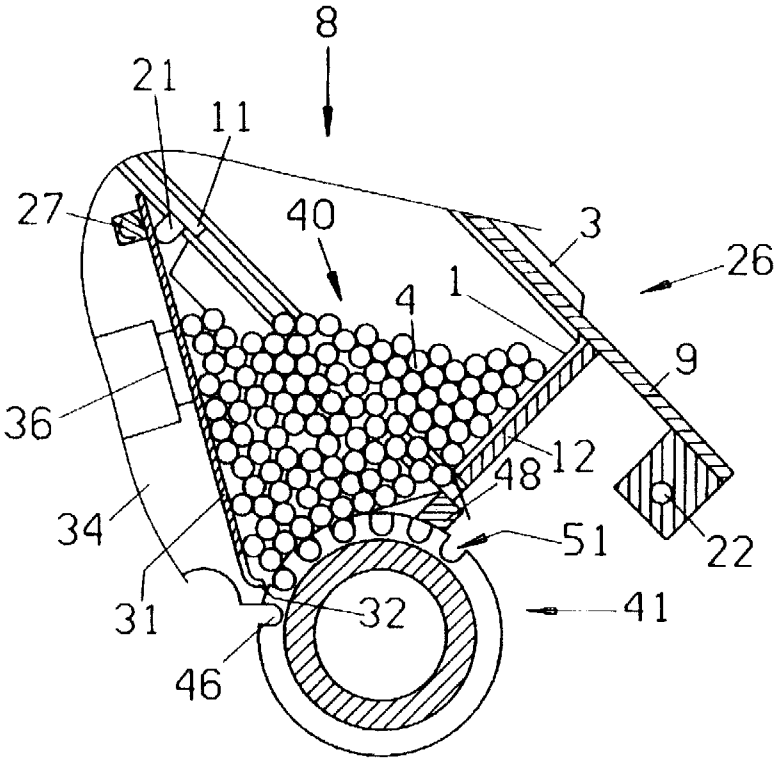
Figure 9:
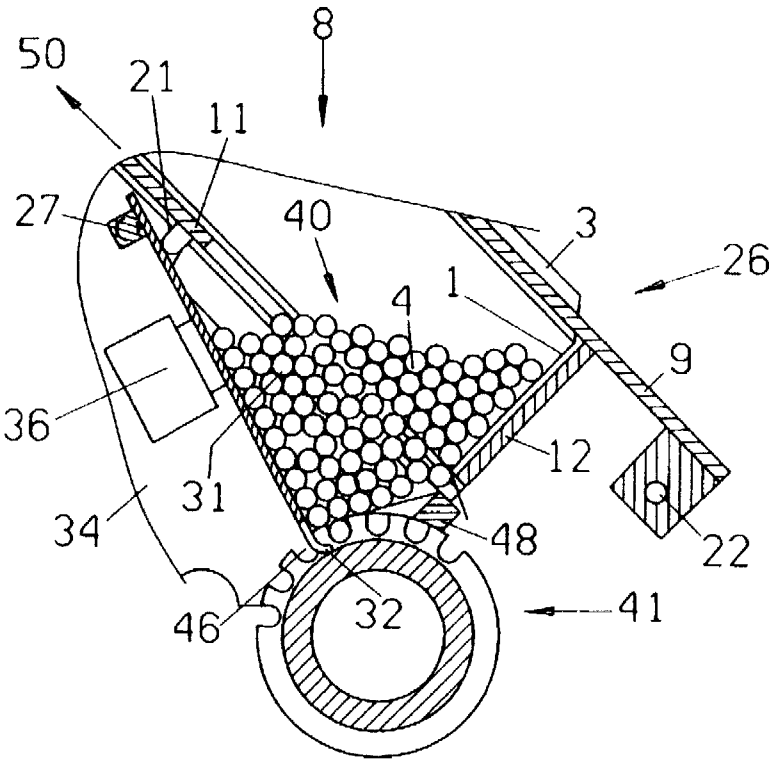

FIG. 7 is a view which is similar to that of FIG. **5*b*** but further shows the invertible receptacle for discrete containers, a filled container in the receptacle and the temporary cover of the receptacle, all in partially inverted positions above a downwardly inclined pivotable top wall of the magazine;

FIG. 8 illustrates all of the structure shown in FIG. 7 but with the converted temporary cover (i.e., a cover temporariy constituting a bottom wall of the partially inverted receptacle) shown in a partly retracted position in which the converted temporary cover automatically maintains the top wall of the magazine in a partially lowered position as compared with the earlier position which is illustrated in FIG. 7 where the inclination of the top wall of the magazine is somewhat less pronounced;

FIG. 9 illustrates the structure shown in FIG. 8 but with the temporary cover of the receptacle in a more retracted position and with the top wall of the magazine pivoted clockwise to a position beyond the position which is shown in FIG. 8; and FIG. 10 illustrates the structure which is shown in FIG. 9 but with the converted temporary cover maintained in a still more retracted position and with the top wall of the magazine lowered beyond the position shown in FIG. 9.

DESCRIPTION OF PREFERRED EMBODIMENTS

Figure 1:
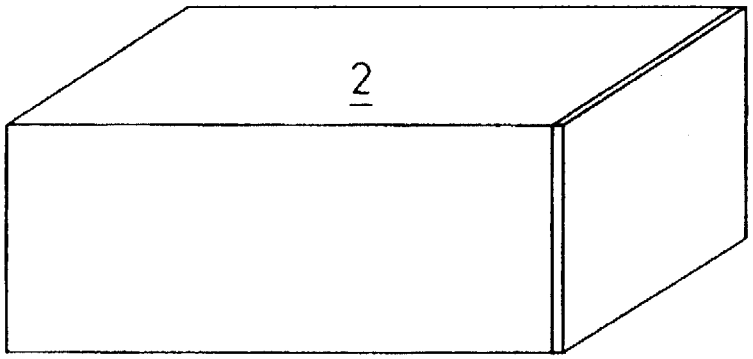
FIG. 1 is a perspective view of a first container for storage of arrayed tubular objects, with the lid shown in a position in which it overlies the top of the container.
Figure 2:
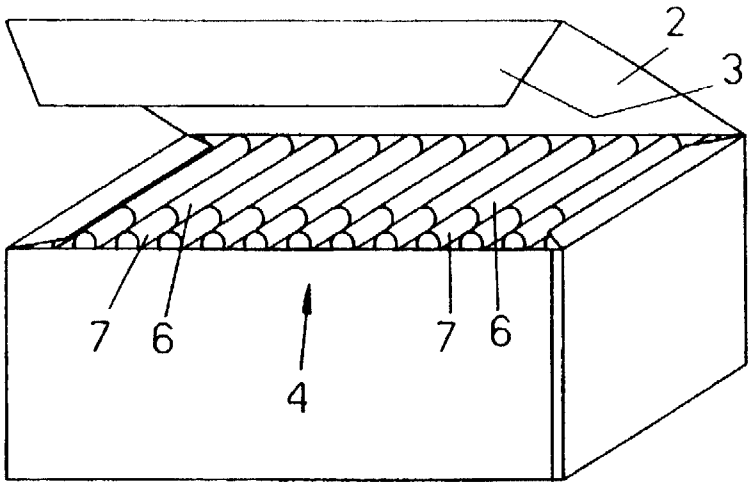
FIG. 2 is a view similar to that of FIG. 1 but showing the lid in a position in which it partially exposes the top of the container and some of the tubular objects therein.

FIGS. 1 and 2 illustrate an elongated container 1 which can be made of plastic, cardboard or other suitable material and is provided with a pivotable lid 2 having a flap 3. The illustrated container is a box which is dimensioned to accommodate an array containing a predetermined number (e.g., two hundred) of elongated at least partially tubular objects 4. Some of the objects 4 can be seen in FIG. 2 which shows the lid 2 in a partly lifted position so as to at least partially expose the top of the container and the uppermost layer or layers of parallel objects 4. Each of these objects is assumed to contain a cylindrical portion 6 of cigarette paper and a filter mouthpiece or filter plug 7 at one axial end of the respective cylindrical portion 6. It is clear that the container 1 or a similar container can contain a predetermined number of tubular objects which are without filter plugs, e.g., cylindrical tubes open at both axial ends and consisting of cigarette paper or other wrapping material for rod-like fillers of particulate smokable material.

Figure 3:
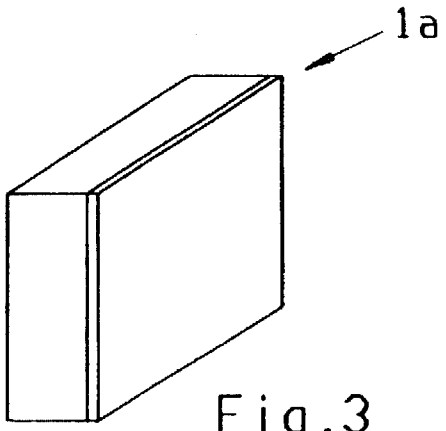
FIG. 3 is a view similar to that of FIG. 1 but showing a relatively small container with the lid shown in the position in which it overlies the top of the container.
Figure 4:
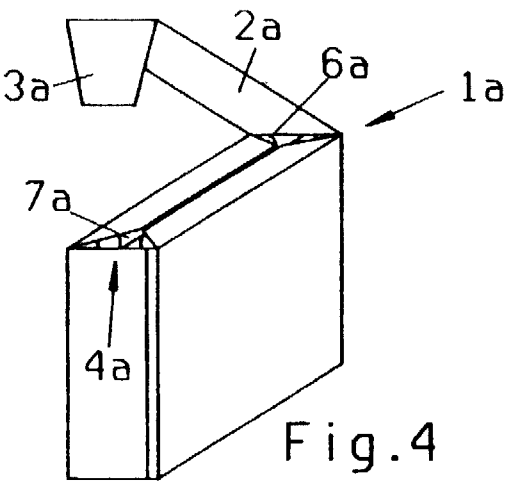
FIG. 4 shows the container of FIG. 3 with the lid in a partly lifted position.

FIGS. 3 and 4 show a relatively small container or box 1*a* which can be dimensioned to temporarily confine an array consisting of a relatively small number (e.g., twenty) of tubular objects 4*a*. The objects 4*a* (some of which can be seen in FIG. 4 which shows the lid 2*a* and its flap 3*a* in partially lifted positions) can be identical with the objects 4, i.e., each object 4*a* can comprise an elongated cylindrical portion 6*a* of cigarette paper and a filter plug 7*a* at one axial end of the respective cylindrical portion 6*a*. The container 1*a* can be designed to receive, or can be replaced with, a container for reception of, a predetermined number of elongated cylindrical objects without filter plugs.

FIGS. 2 and 4 show that the containers 1 and 1*a* are completely filled with arrays of parallel tubular objects 4 and 4*a*, respectively. It is presently preferred to manipulate completely filled containers; however, it is equally possible to manipulate containers which are only partially filled with tubular or basically tubular objects.

The objects 4 and 4*a* are intended for reception of substantially rod-like fillers of condensed or compacted particulate smokable material, e.g., particles of cut or shredded tobacco leaf laminae, fragments of tobacco ribs, fragments of sheets or foils of reconstituted tobacco and/or fragments of substitute tobacco. Depending on the nature of the tubular objects, the ultimate products can constitute plain or filter cigarettes or other rod-shaped articles of the tobacco processing industry. The novel apparatus for the practice of the aforedescribed method can be constructed and assembled in such a way that a container 1 or 1*a* (or the supply of objects 4 or 4*a* therein) is introduced into a receptacle 8. (see FIGS. 5*a* and 7 to 10) which includes, or which cooperates with a mobile temporary cover 11 to transfer successive arrays of tubular objects into a magazine 26 (shown in FIGS. 5*b* and 6 to 10), and that a conveyor 41 (shown in FIGS. 5*b* and 6 to 10) transports successive objects 4 or 4*a* individually from an outlet of the magazine 26 to a filling station 51 (schematically indicated in FIG. 10) where the cylindrical portions 6 or 6*a* receive fillers of comminuted smokable material.

One of the reasons for the provision of the improved method and apparatus is that tubular objects of the type shown at 4 and 4*a* are quite sensitive, i.e., they can readily undergo extensive and mostly permanent deformation if manipulated by hand. Moreover, the material of the cylindrical portions 6 and 6*a* is normally readily smudged or otherwise defaced which detracts from the appearance of smokers' products. Still further, the objects 4 or 4*a* are lightweight components which are likely to lie askew and/or to otherwise change their orientation relative to the neighboring objects, for example, when simply dumped from a container 1 or 1*a* into the magazine 26. Any, even slight, misorientation of the tubular objects entering or coming to rest in the magazine interferes with predictable evacuation of such objects from the magazine and is practically certain to result in at least some deformation or total destruction of the objects before they can reach the filling station 51.

Figure 5A:
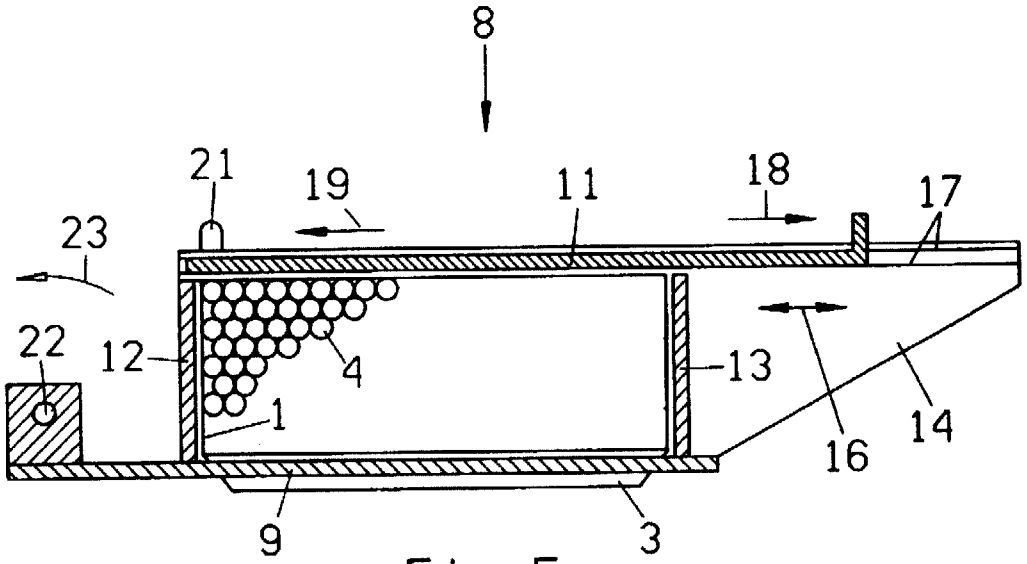

FIG. 5*a* shows that the top of the container 1 in the receptacle 8 is open (i.e., exposed) because the lid 2 and its flap 3 were pivoted out of the way. The receptacle 8 and the container 1 therein are shown in their starting positions in which the flat bottom panel of the container is horizontal and abuts the horizontal bottom wall 9 of the receptacle. The latter further comprises two sidewalls 12, 13 and two end walls 14 (only one can be seen in FIG. 5*a*) which are or which can be made of a light-transmitting material (e.g., transparent plastic). The same applies for other components of the receptacle 8. The end walls 14 carry guide rails 17 for the temporary cover 11 which is movable back and forth in directions indicated by arrows 18 and 19.

The receptacle 8 is assumed to be adjustable so as to vary its capacity. To this end, at least one of its walls 12, 13 is preferably movable in directions indicated by a doble-headed arrow 16.

The temporary cover 11 is pushed or pulled in the direction of the arrow 18 to thus prepare the receptacle 8 for reception of a preferably filled container 1. As mentioned above, the temporary cover 11 is movable along the guide rails 17 carried by the end walls 14. The insertion of a filled container 1 into the receptacle 8 can be carried out by hand; such insertion is preceded by a pivoting of the lid 2 to a position of parallelism with the inner side of the adjacent end wall 14. The flap 3 of the thus pivoted lid 2 can be inserted into an elongated slit between the bottom wall 9 and the illustrated end wall 14 of the receptacle 8. It is assumed that the container 1 has been inserted into the receptacle 8 in such a way that its flat bottom panel rests on the bottom wall 9 and that the filter plugs 7 confront the observer of FIG. 5*a*, i.e., they face the non-illustrated front end wall 14 of the receptacle 8. The temporary cover 11 is thereupon moved along the guide rails 17 in the direction of the arrow 19 so that it overlies the open top of the container 1 in the receptacle 8.

That end portion of the temporary cover 11 which is adjacent the sidewall 12 when the temporary cover overlies the open top of the container 1 is provided with one or more displacing elements 21 in the form of projections made of plastic or other suitable material. The purpose of the displacing element or elements 21 will be explained with reference to FIGS. 8, 9 and 10.

The receptacle constitutes a component of means for partially inverting the container 1 (and with it the temporary cover 11) from the horizontal starting position of FIG. 5*a* to the inclined position of FIGS. 7 to 10 in which the temporary cover 11 and the flat bottom panel of the partially inverted container make with a horizontal plane an angle of less than 90°, preferably at least close to 45°. This involves a pivoting of the receptacle about a stationary fulcrum 22 (e.g., a horizontal shaft) through an angular distance of between about 120° and 150°, preferably at least close to 135°. The direction of pivoting of the receptacle 8 to the partially inverted position is indicated in FIG. 5*a* by an arrow 23.

The receptacle 8 can be pivoted by hand, for example, by grasping the right-hand end portion of the temporary cover 11, as viewed in FIG. 5*a*, and/or by grasping one or both end walls 14. Alternatively, the receptacle 8 can be piloted by a suitable motor or the like, not shown, at least in the direction of arrow 23 or counter to such direction. Once the contents of a container 1 have been transferred into the chamber 40 of the magazine 26, the receptacle 8 and the emptied container 1 are pivoted at 22 back to the horizontal starting positions of FIG. 5*a*, the emptied container 1 is withdrawn from the receptacle, and the latter is ready to receive a filled container 1 for pivoting to the partly inverted position shown for the container 1 of FIGS. 7 to 10. The receptacle 8 is pivoted through an angular distance of between 120° and 150°, for example, at least close to 135°. All that counts is to ensure that the partially inverted temporary cover 11 (which is then converted into a temporary bottom for the inverted open top of the container 1 in the receptacle) makes with a horizontal plane an angle of less than 90°, e.g., at least close to 45°. This ensures predictable transfer of tubular objects 4 from the interior of the partially inverted container 1 into the range of the intermittently driven indexible fluted conveyor 41.

When the partial inversion of the receptacle 8, of the container 1 therein and of the temporary cover 11 is completed, the converted temporary cover overlies the inclined pivotable top wall 31 of the magazine 26. The magazine 26 is located at least in part at a level above the fluted conveyor 41 (see FIGS. 5*b* and 6 to 10), and its top wall 31 is movable (pivotable at 27) in the direction of arrow 28 (FIG. 5*b*) to a plurality of lowered positions including those shown in FIGS. 8, 9 and 10. The top wall 31 of the magazine 26 is pivotable by the distancing element(s) or projection(s) 21 on the converted (partially inverted) temporary cover 11 of the receptacle 8 against the resistance of a coil spring 29 which is shown in FIG. 6. The lower end portion 31*a* of the top wall 31 is provided With a set of slightly upwardly bent tongues or prongs 32. The coil spring 29 is affixed to a lever 33 and pulls the top wall 31 of the magazine 26 to the starting or uppermost position of FIG. 5*b*. The lever 33 is pivotably mounted in upright frame members or lateral walls 34 which further carry the (two-piece) pivot 27 for the top wall 31 and are connected to each other as well as to a stationary support 38 (FIG. 5*b*) by one or more distancing elements 37.

The top wall 31 carries an agitating device 36, e.g., an electromagnetic vibrator, which can be started (either automatically or by hand) to agitate the top wall 31 while the latter is being piloted in the direction of the arrow 28 and/or during intermittent angular movements of the fluted conveyor 41.

FIG. 6 shows that the rotary fluted conveyor 41 is also mounted between the frame members 34; this conveyor can be driven by an electric stepping motor 43 (FIG. 5*b*) in the direction of arrow 44 in order to advance discrete tubular objects 4 from the chamber 40 of the magazine 26 to the filling station 51. The peripheral surface of the conveyor 41 is provided with equidistant axially parallel flutes 46 and the motor 43 is set up to index the conveyor 41 through increments corresponding to distances between the centers of neighboring flutes 46 (as seen in the circumferential direction of the conveyor 41). The illustrated electric motor 43 merely constitutes one of a number of different drives which can be used to index the conveyor 41 through increments of requisite length. It is also possible to rotate or index the conveyor 41 by hand, e.g., by a crank, a wheel or the like.

Figure 5B:
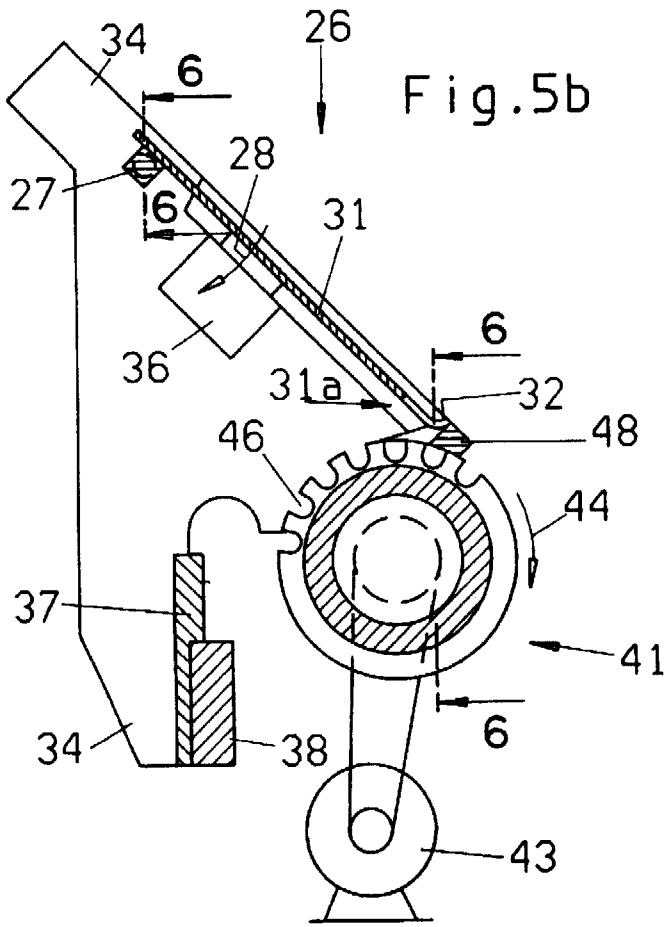

The radially innermost portions of the flutes 46 in the peripheral surface of the conveyor 41 communicate with recesses 47 (see FIG. 6) for the prongs 32 of the top wall 31. FIG. 5*b* shows that, in its uppermost position, the end portion 31*a* of the top wall 31 is adjacent to a distancing element or spacer 48 which is disposed between the frame members 34 and is also provided with recesses 49 for the prongs 32 of the end portion 31*a*. The recesses 47 and 49 ensure accurate (predictable) guidance of the end portion 31*a* during angular movement about the axis of the pivot 27.

The manner of transferring tubular objects 4 from a partly inverted container 1 into the chamber 40 of the magazine 26 and thence to the filling station 51 is illustrated in FIGS. 7 to 10.

FIG. 7 shows the receptacle 8 and the container 1 therein immediately upon completion of the partial inverting step. The converted temporary cover 11 still overlies the open top (actually the underside) of the container 1 in the receptacle 8. The bottom wall 9 can be said to constitute the top wall or cover of the partially inverted receptacle and the converted temporary cover (i.e., the temporary bottom wall) 11 of the receptacle 8 is adjacent to and is slidable relative to the top wall 31 of the magazine 26. The conveyor 41 is idle and the illustrated projection or displacing element 21 of the converted temporary cover 11 bears against the pivotable top wall 31 of the magazine 26 in the region of the end portion 31*a* and prongs 32. A comparison of FIGS. 5*b* and 7 will indicate that the projection 21 has already pivoted the top wall 31 slightly away from the starting angular position of FIG. 5*b*.

In the next step, the person in charge pulls the inverted temporary cover 11 in the direction of the arrow 50 (FIG. 8), i.e., the cover 11 slides along the guide rails 17 and its illustrated projection 21 gradually pivots the top wall 31 in the direction of the arrow 28. At such time, the prongs 32 at the end portion 31*a* of the top wall 31 are guided by the surfaces bounding the recesses 49 in the distancing element 48. The spring 29 is caused to store energy (or additional energy) while the projection 21 causes the top wall 31 to pivot at 27 in the direction of the arrow 28. Such pivoting of the top wall 31 results in the development of an outlet or opening through which some of the tubular objects 4 can descend from the partially inverted container 1 adjacent the lower end portion of the partially retracted converted temporary cover 11. This can be seen in FIG. 8. However, the lower end portion 31*a* of the top wall 31 still prevents the adjacent tubular objects 4 from entering the adjacent flutes 46 of the conveyor 41.

FIG. 9 shows the converted temporary cover 11 in a more retracted position close to the fully retracted position of FIG. 10. The projection 21 has pivoted the top wall 31 from the angular position of FIG. 8 to that which is shown in FIG. 9, and a large number of tubular objects 4 has entered the chamber 40 of the magazine 26. During pivoting from the angular position of FIG. 8 to the further lowered position of FIG. 9, the prongs 32 at the lower end portion 31*a* of the top wall 31 advance through and are guided in the recesses 47 of the conveyor 41. The lowermost tubular objects 4 in the chamber 40 are adjacent the neighboring flutes 46 of the conveyor 41; in fact, they are free to enter such flutes.

FIG. 10 shows the end portion 31*a* of the top wall 31 in its lowermost position, i.e., the retraction of the converted temporary cover 11 to the position of FIG. 10 suffices to ensure that the projection 21 can complete the pivoting of the top wall 31 in the direction of the arrow 28 so that all of the tubular objects 4 can leave the container 1 to enter the chamber 40 and to be evacuated by the flutes 46 of the conveyor 41. At such time, the top wall 31 constitutes the left-hand boundary or sidewall for the chamber 40. The right-hand wall bounding the chamber 40 can be said to be constituted by the right-hand sidewall or panel of the partially inverted container 1 in the receptacle 8.

The motor 43 is thereupon started to index the conveyor 41 in stepwise fashion in the direction of arrow 44. The intermittently driven conveyor 41 receives discrete tubular objects 4 in the flutes 46 which advance toward the filling station 51 where the cylindrical portions 6 of successive objects 4 receive rod-like fillers of particulate smokable material. The manner in which the freshly filled objects 4 are transported away from the filling station 51 (in their respective flutes 46 or otherwise) forms no part of the present invention. The vibrator 36 can be set in operation to agitate the top wall 31 of the magazine 26 during stepwise or continuous retraction of the converted temporary cover 11 in the direction of arrow 50 and/or during stepwise indexing of the fluted conveyor 41. Such agitation of the top wall 31 promotes the entry of tubular objects 4 into the adjacent flutes 46 as well as predictable reception of such objects in their respective flutes.

When the emptying of the container 1 in the partially inverted receptacle 8 is completed, the converted temporary cover 11 is moved along the guide rails 17 counter to the direction indicated by the arrow 50. This enables the spring 29 to dissipate energy and to pivot the top wall 31 counter to the direction of the arrow 28, i.e., back toward and all the way to the starting position of FIG. **5*b*. The receptacle 8 is thereafter pivoted at 22 counter to the direction indicated by the arrow 23, i.e., back to the horizontal or substantially horizontal position of FIG. 5*a*. The empty container 1 is withdrawn and is replaced by a filled container 1; this takes place while the temporary cover 11 is maintained in the retracted position, i.e., subsequent to movement of the cover 11 in the direction of the arrow 18 and away from the position shown in FIG. 5*a*. When the insertion of a filled container 1 into the receptacle 8 is completed, the cover 11 is pushed in the direction of the arrow 19, i.e., back to the position of FIG. 5*a*, and the receptacle 8 is ready to be pivoted to the partially inverted position of FIG. 7**.

The feature that the top wall 31 of the magazine 26 can be pivoted by the projection(s) 21 in response to movement of the converted temporary cover 11 in the direction of the arrow 50 constitutes a highly advantageous but optional characteristic of the improved apparatus and method. Thus, such kinematic coupling of the temporary cover 11 and top wall 31 can be dispensed with by constructing the improved apparatus in such a way that the cover 11 and the top wall 31 can be moved independently of each other. The arrangement can be such that the partially inverted (converted) cover 11 is movable in the direction of arrow 50 in a first step, and such movement of the cover is followed by pivoting of the top wall 31 in the direction of the arrow 28. Other combinations of such translatory and pivotal movements are also within the spirit of the present invention.

It is also possible to simplify the improved method and apparatus in a number of additional ways. For example, the receptacle 8 can be omitted in its entirety. The temporary cover 11 (or an equivalent thereof) is then placed onto the open top of a container 1 or **1*a* prior to placing of the parts 1, 11 or 1*a*, 11 onto the top wall 31 of the magazine 26 in such a way that the exposed side of the converted cover 11 overlies the top wall 31. If desired, such simplified apparatus can be provided with one or more walls (e.g., sidewalls) which are moved against the partially inverted container 1 or 1*a* on the top wall 31 (i.e., on the adjacent side of the cover 11** or its equivalent).

An important advantage of the improved method and apparatus is that the normally highly sensitive tubular objects 4 or **4*a* (or their equivalents) can be treated gently, i.e., without the danger of deformation, defacing and/or tearing. Moreover, the improved method and apparatus greatly reduce the likelihood of undesirable changes of orientation of tubular objects (such as 4 or 4*a*) prior to and during movement of the cover 11 (or its equivalent) to the position of FIG. 5*a*, during introduction of objects into the magazine and/or during transport of objects from the magazine to the filling station 51 or another destination. Any changes of orientation of objects 4 or 4*a* or like sensitive objects are likely to result in deformation and/or other serious damage at least to the cylindrical portions 6 or 6*a*** of the objects.

Additional advantages of the improved method and apparatus are their simplicity and the low cost of the apparatus. Furthermore, the apparatus is or can be versatile, i.e., it can be readily designed to accept larger, smaller and/or differently configurated containers for arrays of tubular objects. Moreover, the improved apparatus occupies a very small amount of space and its operation can be automated to any desired extent.

The manner of forming rod-like fillers or other formations of particulate smokable material or the like for introduction into the cylindrical portions 6 or **6*a* of objects 4 or 4*a* (at the filling station 51 or elsewhere) forms no part of the present invention. For example, the fillers for introduction into the cylindrical portions 6 or 6*a* arriving at the filling station 51** can be formed in a manner as disclosed in commonly owned copending U.S. patent application Ser. No. 08/528,240 filed Sep. 14, 1995 for "Method of and apparatus for assembling accumulations of particulate materials".

The disclosure of the copending application is incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A method of evacuating tubular objects through an open top of an at least partially filled container into and from a magazine, comprising the steps of placing a temporary cover onto the open top of the container; partially inverting the container jointly with the temporary cover to position the temporary cover beneath the partially inverted container above a mobile top wall of the magazine in an inclined plane making an angle of less than 90° with a horizontal plane and to thus convert the temporary cover into a temporary bottom of the partially inverted container; at least partially removing the converted temporary cover from the open top of the partially inverted container; and moving the top wall of the magazine substantially downwardly to at least one lowered position in which the thus lowered top wall bounds an object-receiving chamber of the magazine.

2. The method of claim 1, wherein the tubular objects comprise substantially cylindrical portions of wrapping material for accumulations of particulate smokable material.

3. The method of claim 1, wherein said angle is at least close to 45°.

4. The method of claim 1, wherein the container is a box having a lid movable to and from a position in which the top of the container is open.

5. The method of claim 1, wherein the container has a substantially flat bottom and said step of placing the temporary cover onto the open top of the container includes moving the temporary cover in at least substantial parallelism with the bottom of the container.

6. The method of claim 5, wherein said step of at least partially removing the converted temporary cover includes moving the converted temporary cover in at least substantial parallelism with the bottom of the container.

7. The method of claim 1, wherein said step of at least partially inverting includes pivoting the container and a receptacle therefor through an angular distance of between about 120° and 150°.

8. The method of claim 7, wherein said angular distance is at least close to 135°.

9. The method of claim 7, wherein said pivoting step includes pivoting the container and the receptacle therefor from substantially horizontal positions.

10. The method of claim 1, wherein said step of at least partially removing the converted temporary cover takes place, at least in part, simultaneously with said step of moving the top wall of the magazine substantially downwardly.

11. The method of claim 10, wherein said step of moving the top wall of the magazine is carried out by at least one displacing element of the converted temporary cover.

12. The method of claim 11, wherein the converted temporary cover has a first end portion at a first level and a second end portion at a lower second level, the at least one displacing element being disposed at the second end portion of the converted temporary cover.

13. The method of claim 1, further comprising the step of evacuating tubular objects from the chamber of the magazine by an intermittently driven rotary fluted conveyor subsequent to movement of the top wall of the magazine to said at least one lowered position.

14. The method of claim 13, wherein said step of evacuating objects from the chamber of the magazine includes transporting tubular objects to a filling station.

15. The method of claim 14, further comprising the step of agitating the top wall of the magazine during transport of objects to the filling station.

16. The method of claim 1, further comprising the step of agitating the top wall of the magazine during movement of the top wall to said at least one lowered position.

17. Apparatus for evacuating tubular objects through an open top of an at least partially filled container into and from a magazine, comprising a removable temporary cover for the open top of the container; means for partially inverting the container jointly with the temporary cover to position the temporary cover beneath the partially inverted container above a mobile top wall of the magazine in an inclined plane making an angle of less than 90° with a horizontal plane and to thus convert the temporary cover into a removable temporary bottom for the partially inverted container; and means for moving said top wall of the magazine substantially downwardly to at least one lowered position.

18. The apparatus of claim 17, wherein said angle is at least close to 45°.

19. The apparatus of claim 17, wherein the tubular objects comprise substantially cylindrical portions of wrapping material for accumulations of particulate smokable material.

20. The apparatus of claim 17, wherein the container is a box having a lid movable to and from a position in which the top of the container is open.

21. The apparatus of claim 17, wherein said means for partially inverting comprises a receptacle for containers with open tops.

22. The apparatus of claim 21, wherein said receptacle comprises guide means for said temporary cover, said temporary cover being movable relative to the container in said receptacle to and from a position in which the temporary cover at least substantially overlies the open top of the container in the receptacle.

23. The apparatus of claim 22 for evacuating objects from containers having substantially flat bottoms, wherein said guide means is positioned to maintain said temporary cover in substantial parallelism with the bottom of the container in said receptacle, said converted temporary cover being movable relative to said guide means in the partially inverted position of the container in said receptacle from a position of overlap with the open top of the partially inverted container.

24. The apparatus of claim 17, wherein said means for partially inverting the container includes means for pivoting the container back and forth through angular distances of between about 120° and 150°.

25. The apparatus of claim 24, wherein said angular distances at least approximate 135°.

26. The apparatus of claim 17, wherein said converted temporary cover is movable relative to the open top of the partially inverted container and said means for moving said top wall shares the movements of said converted temporary cover.

27. The apparatus of claim 26, wherein said converted temporary cover includes a first end portion disposed at a first level and a second end portion disposed at a lower second level, said means for moving said top wall being disposed at the second end portion of the converted temporary cover.

28. The apparatus of claim 26, wherein said means for moving said top wall of the magazine includes at least one projection on said temporary cover.

29. The apparatus of claim 17, further comprising means for transporting discrete objects from said magazine to a filling station.

30. The apparatus of claim 29, wherein said means for transporting comprises a rotary fluted conveyor and means for rotating said conveyor in stepwise fashion, said conveyor being located at least in part beneath said magazine.

31. The apparatus of claim 30, further comprising means for agitating said top wall at least during rotation of said conveyor.

32. The apparatus of claim 17, further comprising means for agitating said top wall at least during movement of the top wall to said at least one lowered position.

* * * * *